US008146732B2

(12) United States Patent
Crafton

(10) Patent No.: US 8,146,732 B2
(45) Date of Patent: Apr. 3, 2012

(54) DRIVE HEAD ASSEMBLY FOR A FLUID CONVEYOR SYSTEM

(76) Inventor: Jim Crafton, Evergreen, CO (US)

( * ) Notice: Subject to any disclaimer, the term of this patent is extended or adjusted under 35 U.S.C. 154(b) by 375 days.

(21) Appl. No.: 12/586,254

(22) Filed: Sep. 18, 2009

(65) Prior Publication Data

US 2010/0236788 A1 Sep. 23, 2010

Related U.S. Application Data

(60) Provisional application No. 61/192,432, filed on Sep. 18, 2008.

(51) Int. Cl.
*E21B 43/00* (2006.01)

(52) U.S. Cl. ..... 198/643; 166/67; 166/369

(58) Field of Classification Search ..... 198/643; 166/67, 369

See application file for complete search history.

(56) References Cited

U.S. PATENT DOCUMENTS

| | | | | | |
|---|---|---|---|---|---|
| 1,017,847 | A | | 3/1910 | Carl | |
| 1,799,086 | A | | 2/1929 | Caretta | |
| 1,740,821 | A | * | 12/1929 | Kneuper | 198/497 |
| 2,121,931 | A | | 7/1936 | Sloan | |
| 2,289,706 | A | * | 7/1942 | Hay et al. | 198/643 |
| 2,704,981 | A | | 11/1953 | Gustafson | |
| 3,779,171 | A | | 12/1973 | Littlehorn, Jr. | |
| 4,236,696 | A | | 12/1980 | Hicks et al. | |
| 4,652,372 | A | | 3/1987 | Threadgill | |
| 4,962,847 | A | * | 10/1990 | Pisors et al. | 198/643 |
| 5,048,670 | A | * | 9/1991 | Crafton et al. | 198/643 |
| 5,080,781 | A | | 1/1992 | Evins, IV | |
| 5,381,861 | A | | 1/1995 | Crafton et al. | |
| 5,415,106 | A | | 5/1995 | Groskreutz et al. | |
| 5,423,415 | A | | 6/1995 | Williams | |
| RE35,266 | E | | 6/1996 | Crafton et al. | |
| 5,626,081 | A | | 5/1997 | Kuryu | |
| 6,158,514 | A | | 12/2000 | Gano et al. | |

* cited by examiner

*Primary Examiner* — Mark A Deuble
(74) *Attorney, Agent, or Firm* — Schultz & Associates, P.C.

(57) ABSTRACT

The invention disclosed provides a drive head assembly for a fluid conveyor system that propels a fluid entraining conveyor through a well bore to carry fluids to the surface. The invention is comprised of a pair of synchronized follower wheels connected to a set of counter rotating sheaves. A fluid entraining conveyor is wrapped in a "figure-8" conveyor path around the sheaves in a plurality of coaxial grooves and around a distal sheave located in the fluid in the well bore. The coaxial grooves incorporate a unique shape which in conjunction with the wrap pattern provide improved tractive qualities and thus reduce tension in the conveyor and increase the durability of the conveyor. The conveyor can run at increased speeds and with no tension on the downward portion of the conveyor resulting in higher efficiency and less down time due to breakage.

25 Claims, 9 Drawing Sheets

DRIVE HEAD ASSEMBLY FOR A FLUID CONVEYOR SYSTEM

CROSS-REFERENCE TO RELATED APPLICATIONS

This application claims priority to U.S. Provisional Application No. 61/192,432 entitled "Drivehead Assembly For A Rope Pump System," filed on Sep. 18, 2008.

FIELD OF THE INVENTION

The present invention relates to an improved method and apparatus for moving fluid. In particular, the invention relates to a synchronized drive head assembly containing a set of counter rotating sheaves with an endless conveyor and used to move fluids.

BACKGROUND OF THE INVENTION

Using a continuous rope or belt as a conveyor looped between a sheave at a particular destination and a sheave at a particular origin to move fluid is known in the prior art. Often the fluid conveyor is used to lift water or oil from beneath the surface of the ground to a storage receptacle on the surface. In this specific use of lifting fluid up to the surface, a well bore of sufficient length to reach the fluid is drilled and a fluid entraining conveyor or belt is secured around a sheave submerged in the fluid. A sheave system rigged on the surface is designed to minimize the effort required to lift the fluid entraining conveyor to the surface. The system must have sufficient traction between the sheaves and the conveyor to lift the combined weight of the conveyor and the fluid. Typical fluid conveyors of the prior art use a mechanical device to turn one sheave which pulls a rope up out of a well and returns the rope back into the well as it unwinds off the sheave. The fluid in the well follows the rope up and is subsequently collected in a containment vessel on the surface.

The efficiency of a fluid conveyor is determined by the amount of product collected as compared to the amount of energy used to run the device. Efficiency is lost when the conveyor slips on the drive sheave due to low traction between the conveyor and the sheave. Slippage causes wear on the conveyor and therefore reduces its useful life. To generate sufficient traction to prevent slippage, tension in the rope is typically high. The tension in the conveyor being a combination of factors such as, the type of fluid being lifted, the speed of the conveyor, the diameter of the conveyor, and the friction of the conveyor against the sheaves. A common problem with the fluid conveyors of the prior art is the failure of the conveyor due to slippage or high tension. The typical lifespan of the conveyor used in the prior art is approximately ninety (90) days. The relatively short lifespan of the conveyor increases the cost of the system which is a distinct disadvantage of the prior art.

Typical of the prior art is U.S. Pat. No. 4,652,372 to Threadgill. Threadgill discloses a liquid separator utilizing an endless belt for skimming extraction of oil from a liquid body and doctoring rollers for gathering the oil from both sides of the belt. The endless belt is fabricated from a material which is preferentially wettable by the liquid to be extracted. One drive roller winds the belt up out of the well and around a pair of doctoring rollers. Both sides of the belt engage a doctoring roller to skim the liquid off the belt. An additional roller positioned in the liquid maintains tension in the belt. The tension in the belt and the skimming process needed to remove the liquid from both sides of the belt tend to shorten the lifespan of the belt.

U.S. Pat. No. 6,158,515 to Greer, et al. discloses an artificial lifting device for well fluids using a continuous loop of fibrous material, such as a rope. The rope loop is formed around a drive sheave on the surface with a return sheave down inside of the well. The drive sheave has ridges along the side surfaces of a groove. The rope lays in the groove in contact with the ridges. A motor rotates the drive sheave, as guides and wipers direct the rope into the drive sheave and to the wipers. The wipers are slotted cards that scrape a quantity of fluid from the outside surface of the rope. The useful life of the rope is diminished by the contact with the ridges in the groove and the scraping of the wipers.

U.S. Pat. No. 5,080,781 to Evins, IV discloses a down-hole hydrocarbon collector that incorporates an endless absorption belt for collecting low-viscosity hydrocarbon liquids from a well and pumping those liquids to the surface. The collector of the invention has a means for driving the belt through a body of liquid to absorb low-viscosity hydrocarbons, which includes rollers engaging the endless belt in a manner that squeezes the hydrocarbons from the belt. The use of springs enables the squeezing of the belt between rollers. The squeezing of the belt exposes the belt to additional abrasion and hence limits its lifespan.

U.S. Pat. No. 5,423,415 to Williams discloses a rope pump for conveying fluid-like material from a reservoir to a select location. The surface assembly for the rope pump includes an endless rope, sheaves for forming the endless rope into a loop extending between the reservoir and the select location and a drive for driving the rope about the sheaves. The drive includes a first and second sheave each having a plurality of circumferential grooves. The endless rope is wrapped between the first and second sheaves in the grooves in a block and tackle fashion. A tensioning wheel biases the rope to maintain the rope in constant engagement with the final grooves of the first and second sheave. The tensioning wheel provides constant tension on the rope on the drive sheaves to continuously eliminate rope slack. The constant tension in the rope, especially on the downward side of the loop puts undue strain on the rope and reduces its lifespan.

SUMMARY OF INVENTION

The preferred embodiment of the present invention provides an efficient and dependable device for driving a conveyor through the length of a well bore to collect fluids. The present invention incorporates two synchronized sheaves. A "figure-8" conveyor path between the synchronized sheaves maximizes the contact of the conveyor with the sheaves and not only improves traction between the sheaves and the conveyor but also allows for zero tension on the conveyor as it reenters the tubing in the well bore. The sheaves include coaxial grooves, each having a unique and novel cross-section that further improves traction without unnecessary abrasion on the conveyor. Under normal working load conditions, as measured by conveyor tension, the invention significantly increases conveyor lifespan.

Accordingly, an embodiment of the present invention provides a drive head assembly for a fluid conveyor which includes a double sided drive mechanism, such as gears or a double sided drive belt, engaged with a drive wheel and three follower wheels. A first follower wheel shares a rotational axis with a first sheave. A second follower wheel shares a rotational axis with a second sheave. The drive mechanism engages the first and second follower wheels in such a way as to impart a synchronous but opposite rotation to them. The first and second sheaves are connected to the first and second follower wheels respectively via shared rotational axes. The first and second follower wheels impart a synchronous but opposite rotation to the first and second sheaves. The first and second sheave each has a set of coaxial grooves. The preferred embodiment has four coaxial grooves on each sheave. Each groove on the first sheave matched to a groove on the second sheave to form a set of grooves. An endless conveyor follows a "figure-8" conveyor path, through each groove between the sheaves. The "figure-8" conveyor path maximizes the contact surface between the sheaves and the conveyor providing improved traction on the conveyor. The cross-sectional area of the conveyor expands as tension in the conveyor is reduced following each loop around the pair of sheaves. Similarly, the width of each consecutive groove increases to accommodate the conveyor. The depth of each groove, between the lowest portion of each groove and the center of the sheave, is also related to the cross-sectional area of the conveyor. The first groove of each sheave is slightly shallower than that of the adjacent groove which is slightly shallower than the next adjacent groove and so forth. As a result of the progressive increase in depth of each groove, the distance between the cross-sectional center of the conveyor and the rotational axis is slightly reduced in each consecutive groove of the sheave. The conveyor travels down a two-channeled tubing to a remote sheave and returns up the tubing to the sheaves entraining fluid from a reservoir. The drive head assembly of the present invention is surrounded by a sealed cover. The cover, which acts as a containment vessel, protects the environment from the fluids lifted. Additionally, the cover allows a pressurized interior, if necessary, and collects the fluid entrained on the returning conveyor. An outlet port in the cover directs the collected fluid to a holding tank.

A single pair of sheaves is described for simplicity. However, the drive head may contain more than two sheaves.

Those skilled in the art will further appreciate the above-mentioned features and advantages of the invention together with other important aspects upon reading the detailed description that follows in conjunction with the drawings.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
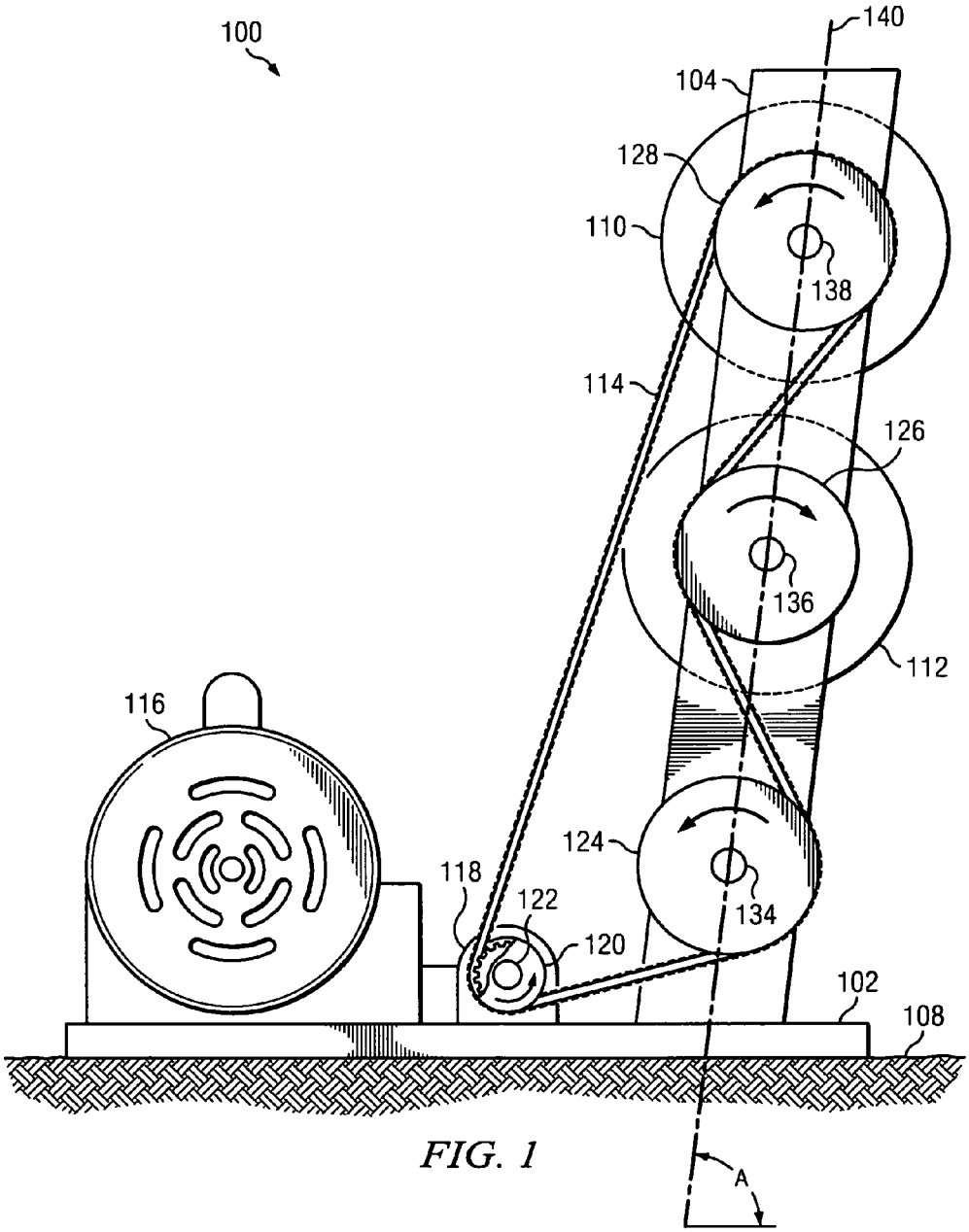
FIG. 1 is an elevation view of the drive head of a preferred embodiment with the cover removed.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
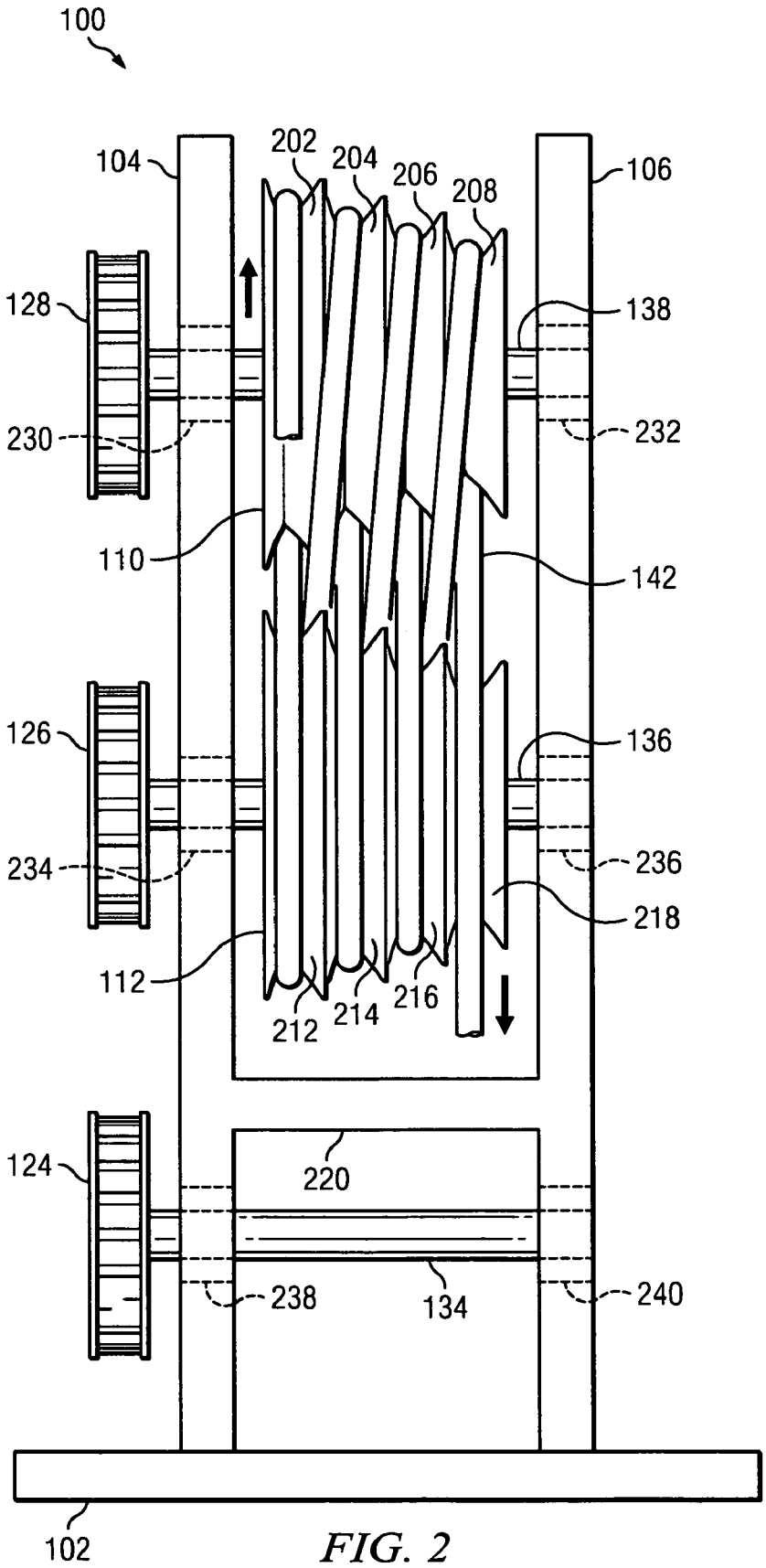
FIG. 2 is an elevation view of the drive head of a preferred embodiment showing the conveyor path.
Figure 6:
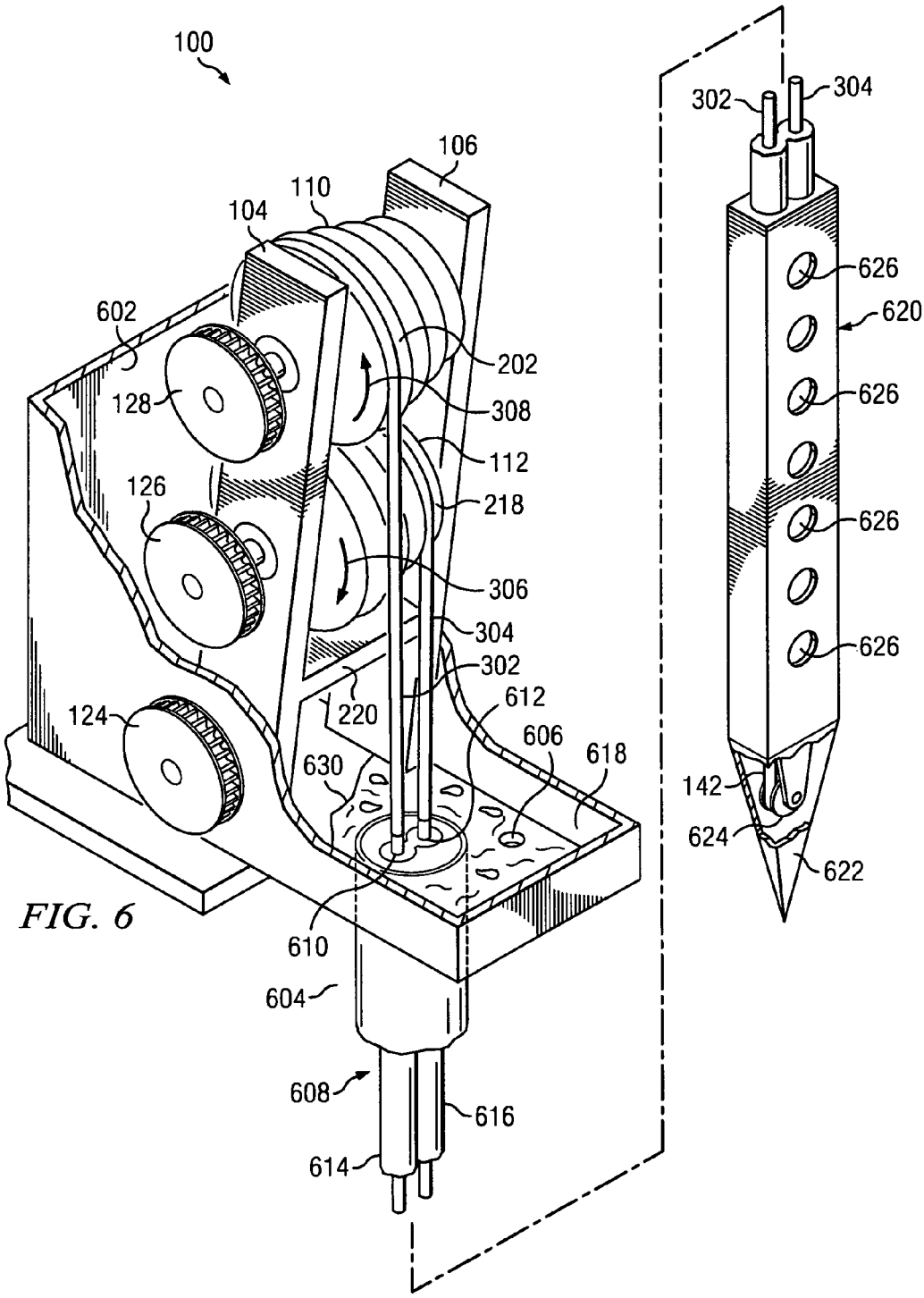
FIG. 6 is an isometric view of the drive head of a preferred embodiment.

FIGS. 1, 2 and 6 show a preferred embodiment of drive head 100. Base 102 provides a connecting platform for motor 116, transmission 118, and frames 104 and 106. In the preferred embodiment, base 102 is mounted to ground surface 108 via a concrete slab. Brace 220 stabilizes frame 104 to frame 106. Frames 104 and 106 are parallel to each other and extend from base 102 at angle A. Angle A may be any angle, including perpendicular. In the preferred embodiment, angle A ranges from 80° to 85°.

In the preferred embodiment, motor 116 generates up to 10 horsepower and is powered by fuel or electricity. However, motor 116 may be of any size or type. The size of motor 116 may be altered to account for the weight of the conveyor 142, density of the fluid, speed of operation, the size of the sheaves 110 and 112, and the size of follower wheels 124, 126, and 128. Motor 116 is removably secured to base 102 and is additionally connected to transmission 118 to provide rotational motion to drive shaft 122. Drive shaft 122 extends from transmission 118. Drive wheel 120 is notched along its perimeter and is concentrically mounted on drive shaft 122. Drive shaft 122 provides a rotational axis for drive wheel 120.

Follower wheels 124, 126, and 128 are concentrically mounted on one end of shafts 134, 136, and 138 respectively. In the preferred embodiment, follower wheels 124, 126, and 128 are all generally equal in shape and size and their midpoints are linearly aligned on the longitudinal midline 140 of frame 104. In the preferred embodiment, the diameter of follower wheels ranges from 8 to 10 inches. However, the follower wheels 124, 126, and 128 may be of any size. Additionally, geometry could be selected such that follower wheels 124, 126, and 128 were not the same size as each other. The size of the follower wheels 124, 126, and 128 are generally selected based on the weight of the conveyor 142, the diameter of sheaves 110 and 112, density of the fluid and power of the motor 116. Additionally, in a different prepared embodiment follower wheels 124 and 134 are not used.

Shafts 134, 136, and 138 are mounted in and perpendicularly extend between frames 104 and 106. Rotating shaft support 230 mounted in frame 104 and rotating shaft support 232 mounted in frame 106 provide for rotation of shaft 138. Rotating shaft support 234 mounted in frame 104 and rotating shaft support 236 mounted in frame 106 for rotation of shaft 136. Rotating shaft support 238 mounted in frame 104 and rotating shaft support 240 mounted in frame 106 for rotation of shaft 134. Additionally, in a different preferred embodiment, Follower wheels 124 and 134 are not used.

In a preferred embodiment, the perimeter of follower wheels 124, 126, and 128 have equally spaced cogs for engagement with double-sided toothed belt 114. Belt 114 has teeth on opposite surfaces for engagement with the notches of drive wheel 120 and the cogs of the follower wheels. Belt 114 is propelled by drive wheel 120.

As shown in FIG. 1, belt 114 winds from drive wheel 120, around follower wheel 124, crosses midline 140, around follower wheel 126, crosses midline 140 again, around follower wheel 128, and back down to drive wheel 120. The arrows shown on drive wheel 120 and the follower wheels indicate the rotational direction of the follower wheels with respect to the drive wheel. Belt 114 is wound as such to ensure that follower wheels 126 and 128 rotate in opposite directions. Although follower wheels 126 and 128 rotate in opposite directions, belt 114 synchronizes them to rotate at the same speed.

Sheave 110 is generally cylindrical in shape and is rigidly mounted to shaft 138. Shaft 138 is a rotational axis for sheave 110. Sheave 112 is generally cylindrical in shape and is rigidly mounted to shaft 136. Shaft 136 is a rotational axis for sheave 112. Follower wheel 128, shaft 138, and sheave 110 all rotate in unison and in an opposite direction of follower wheel 126, shaft 136, and sheave 112 which also rotate in unison. Because follower wheel 126 and 128 are synchronized to rotate at the same speed in opposite directions, it follows that sheaves 110 and 112 are also synchronized and rotate at the same speed in opposite directions. In the preferred embodiment, sheave 110 and follower wheel 128 rotate at the same RPM as sheave 112 and follower wheel 126.

Figure 4:
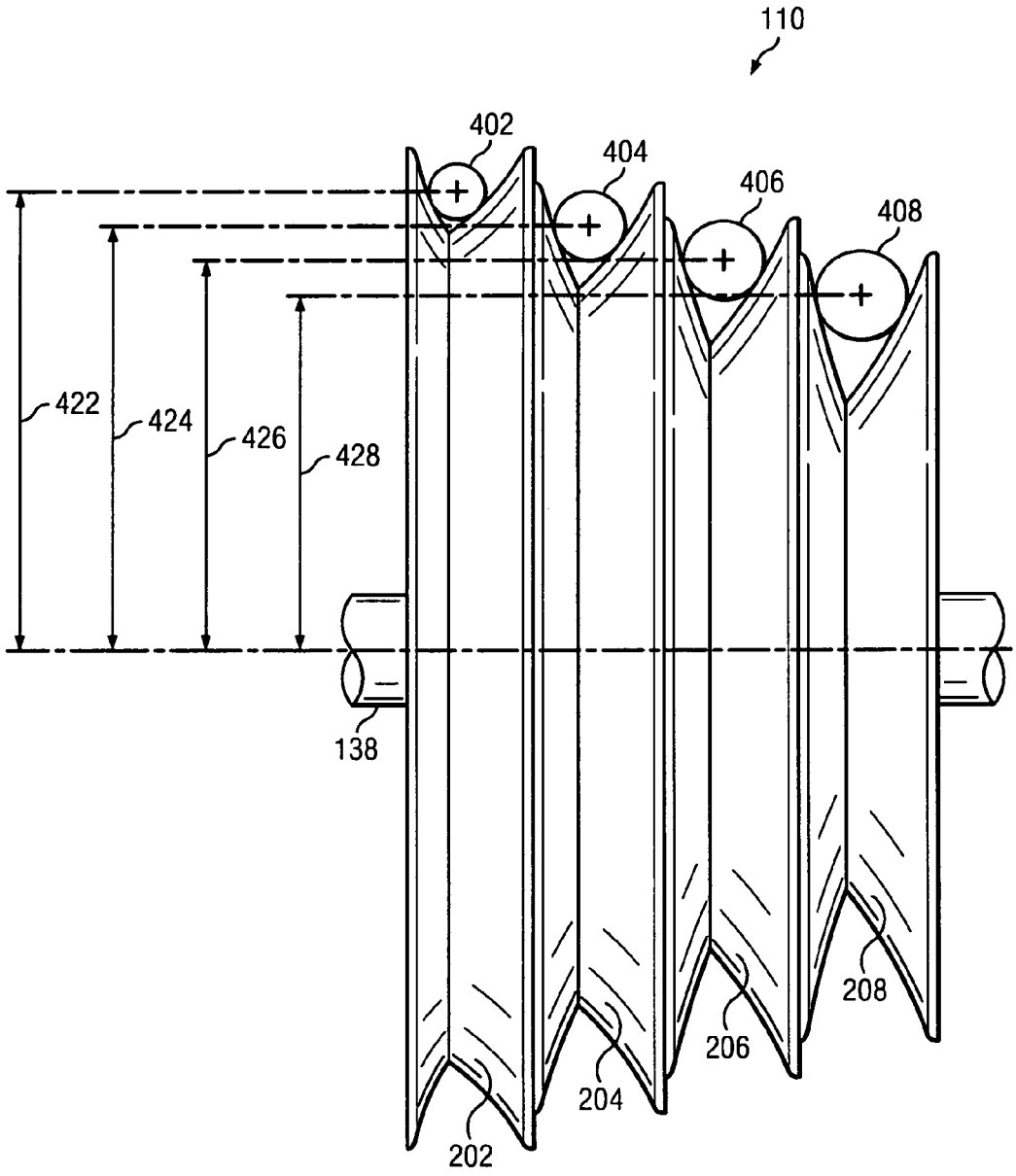
FIG. 4 is a partial elevation view of a sheave of a preferred embodiment showing the cross-section areas of the conveyor.

As shown in FIGS. 2, 4, and 6, sheave 110 in a preferred embodiment of the present invention is made up of four integrally formed coaxial grooves 202, 204, 206, and 208. In alternate embodiments, the total number of grooves on each sheave varies depending on the depth of the well bore and the traction required. The total number of grooves on each sheave is determined by the amount of tractive force required to propel the conveyor. The curvature of the groove walls has a cross sectional profile determined by a function described in FIG. 9. The grooves are adjacent each other and increase in width as the diameter of the conveyor 142 increases. Thus, the cross sectional profile of groove 202 (and conveyer segment 402) is the most narrow and groove 208 (and conveyor segment 408) is the widest. Generally, the ratio of the profile of groove 202 to the profile of groove 204 and the ratio of the profile of groove 204 to the profile of groove 206 and so forth should be in the range of 1.01 to 1.1. The width of the groove profile depends on the elasticity of the conveyor (which is assumed to be constant) and the amount of tensile force applied to it. The tensile force applied to the conveyor is a function of the diameter of the conveyor, the speed at which the conveyor is being propelled, the viscosity of the fluids being moved, and overall weight of the conveyor. The functions are more fully explained with the descriptions of FIGS. 9 and 10 that follow.

In the preferred embodiment, sheave 112 is generally the same size as sheave 110. Sheave 112 is also made up of four integrally formed coaxial grooves 212, 214, 216, and 218. The grooves are adjacent each other and linearly step down in radius where groove 212 has the largest radius and groove 218 the smallest, as described for sheave 110 above.

FIG. 4 shows a partial view of sheave 110. It is understood that sheave 112 is structurally similar. The step down in radius of the grooves is necessary to counteract the expanding diameter of conveyor 142. Accordingly, radius 422 of groove 202 is greater than radius 424 of groove 204. Radius 424 of groove 204 is greater than radius 426 of groove 206. Radius 426 of groove 206 is greater than radius 428 of groove 208. As conveyor 142 loops around the grooves of the sheaves (the preferred path to be described below), tension is lessened and the cross-sectional area of conveyor 142 increases. In the preferred embodiment, distance 422 ranges from approximately 5.5 to 6 inches to as small as 2 inches. However, distance 422 may be of any size. Distance 422 may be selected based on the diameter of follower wheels 124, 126, and 128, weight of conveyor 142, density of fluid 630 and size of motor 116. Because of the elasticity of the conveyor, as tension in a segment of conveyor 142 is reduced the length of the segment is also reduced. Therefore the shorter radius of each sequential groove is necessary to keep slack out of the windings and prevent slippage. Slippage produces unwanted wear on the conveyor.

Figure 5:
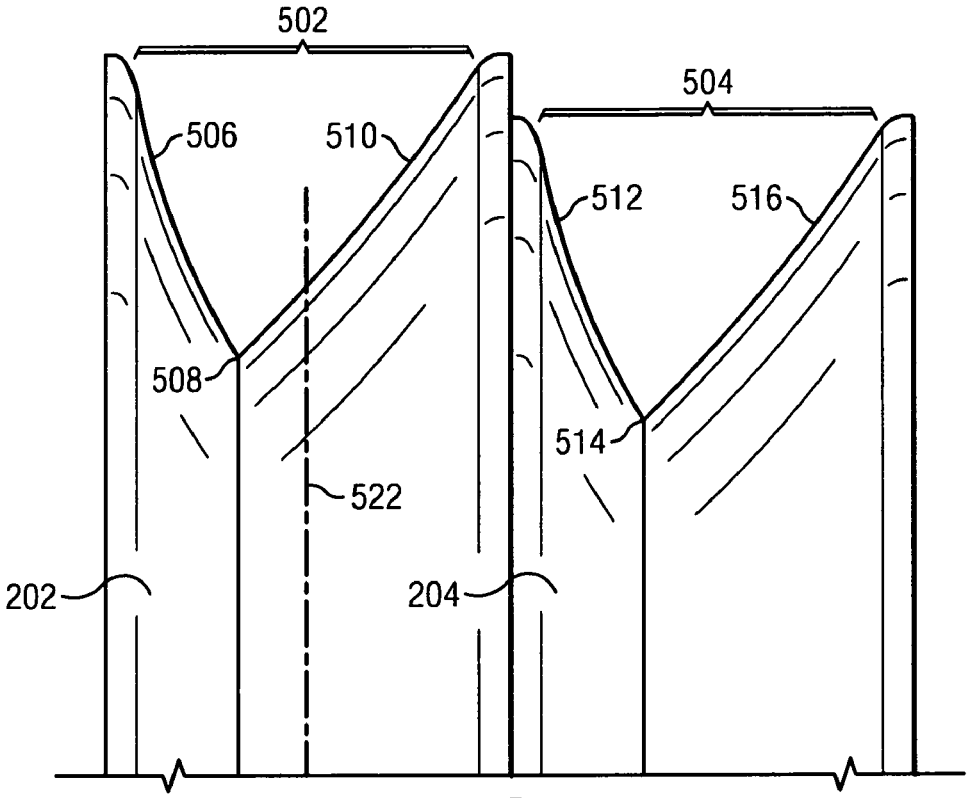
FIG. 5 is a close up elevation view of a groove of a preferred embodiment.

FIG. 5 shows the shape of the conveyor receiving grooves. The cross-section of each groove has two sides, each side having a different profile and slope, as described by equations 11 and 13, due to point 508 not being located along centerline 522 of groove 202. For clarity, only grooves 202 and 204 are shown. It is understood that all additional grooves will be similarly shaped. The unique shape of the grooves eliminates the need for tension on down portion 304 of conveyor 142 and grips the conveyor without cinching the conveyor thereby prolonging conveyor life. Groove 202 includes profile 502 and groove 204 includes profile 504. Profile 502 is formed by the two curves 506 and 510 which are defined by a specific equation. The equation is a function of the groove radius and the pitch between alternate grooves on different sheaves. As previously mentioned and shown later with the descriptions of FIGS. 9 and 10, the groove radius depends on the elasticity of the conveyor and the amount of tensile force applied to the conveyor. The tensile force applied to the conveyor is a function of the diameter of the conveyor, the speed at which the conveyor is being propelled, the viscosity of the fluids being moved, and the overall weight of the conveyor. Curve 506 and 510 intersect at point 508. Intersection point 508 is located off centerline 522. Because the intersection point of curves 506 and 510 is off centerline 522, curve 510 has a more gradual slope than curve 506 and the conveyor naturally rests in profile 502 off-center as well. Curve 506 provides a less obstructive angle of departure as conveyor 142 proceeds from one groove on a sheave to another groove on a different sheave. Profile 504 is formed by the two curves 512 and 516 which intersect at point 514 and are defined by a different equation. The equation is not the same as the equation for curves 506 and 510 defining profile 502 because the equations are a function of groove radius and the radius of groove 204 is less than that of groove 202.

Figure 3:
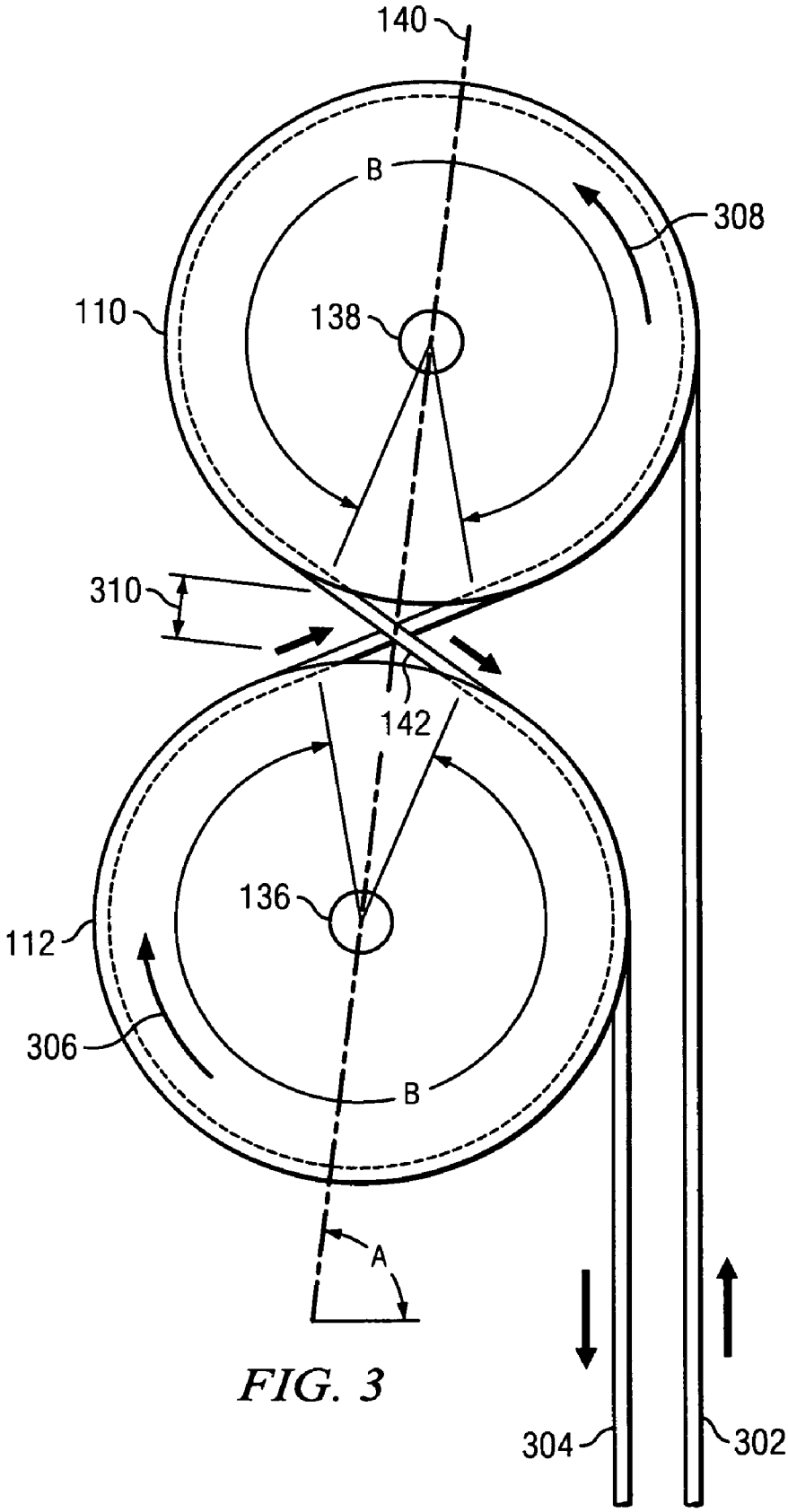
FIG. 3 is a partial elevation view of the sheaves of a preferred embodiment showing the conveyor path.

As best shown in FIG. 3, sheave 110 is located distance 310 from sheave 112. As conveyor 142 passes from sheave 110, crosses midline 140 and loops back around on sheave 112, conveyor 142 generally makes contact with a majority of the perimeter of each sheave. As the conveyor first enters sheave 110 from the well bore and finally exits sheave 112 to enter the well bore, the contact with sheaves 110 and 112 is reduced as the conveyor 142 enters and leaves vertically. This is further described in equation 1. Conveyor 142 continues this "figure-8" conveyor path, alternating between the sheaves for as many grooves as there are in each sheave. As distance 310 decreases, the more contact conveyor 142 makes with each sheave and thus more tractive force. The optimal distance between the sheaves maximizes the contact conveyor 142 has with the perimeters of each sheave while still allowing enough space for conveyor 142 to cross grooves without obstruction. Conveyor 142 contacts both sheaves through angle B. In the preferred embodiment, angle B ranges from 320° to 340° except for the first and last groove as described above. The more surface contact conveyor 142 has with the sheaves, the more tractive force will be produced.

Referring to FIG. 6, cover 602 is generally rectangular and hollow. Cover 602 encases frames 104 and 106 and sheaves 110 and 112. Follower wheels 124, 126, and 128 are adjacent cover 602 and located on the exterior of cover 602. Cover 602 further defines entrance hole 610 and exit hole 612. Drain hole 606 allows the fluid moved from the reservoir to be removed from collection area 618 and transported to an additional storage receptacle. Standpipe 604 is fitted to the underside of cover 602 below collection area 618. Standpipe 604 extends from the upper portion of the well bore.

The preferred path of conveyor 142 can be seen in FIGS. 2, 3, and 6. Up portion 302 of conveyor 142 enters drive head 100 through entrance hole 610 in cover 602. It is not necessary for conveyor 142 to be perpendicular to base 102 while it is in the enclosed area of cover 602. Up portion 302 must have an unobstructed path from entrance hole 610 to groove 202 and down portion 304 must have an equally unobstructed path from groove 218 to exit hole 612. After entering cover 602, conveyor 142 passes over and around sheave 110 in groove 202. Conveyor 142 leaves groove 202, crosses midline 140 between the sheaves and rounds sheave 112 in groove 212 in an opposite rotational direction than around sheave 110. Arrows 306 and 308 indicate the rotational directions of each sheave are opposite each other. Conveyor 142 then leaves groove 212, crosses midline 140 and rounds sheave 110 in groove 204. This "figure-8" conveyor path continues for the remaining grooves until conveyor 142 leaves groove 218 and down portion 304 exits covers 602 through exit hole 612.

Figure 7:
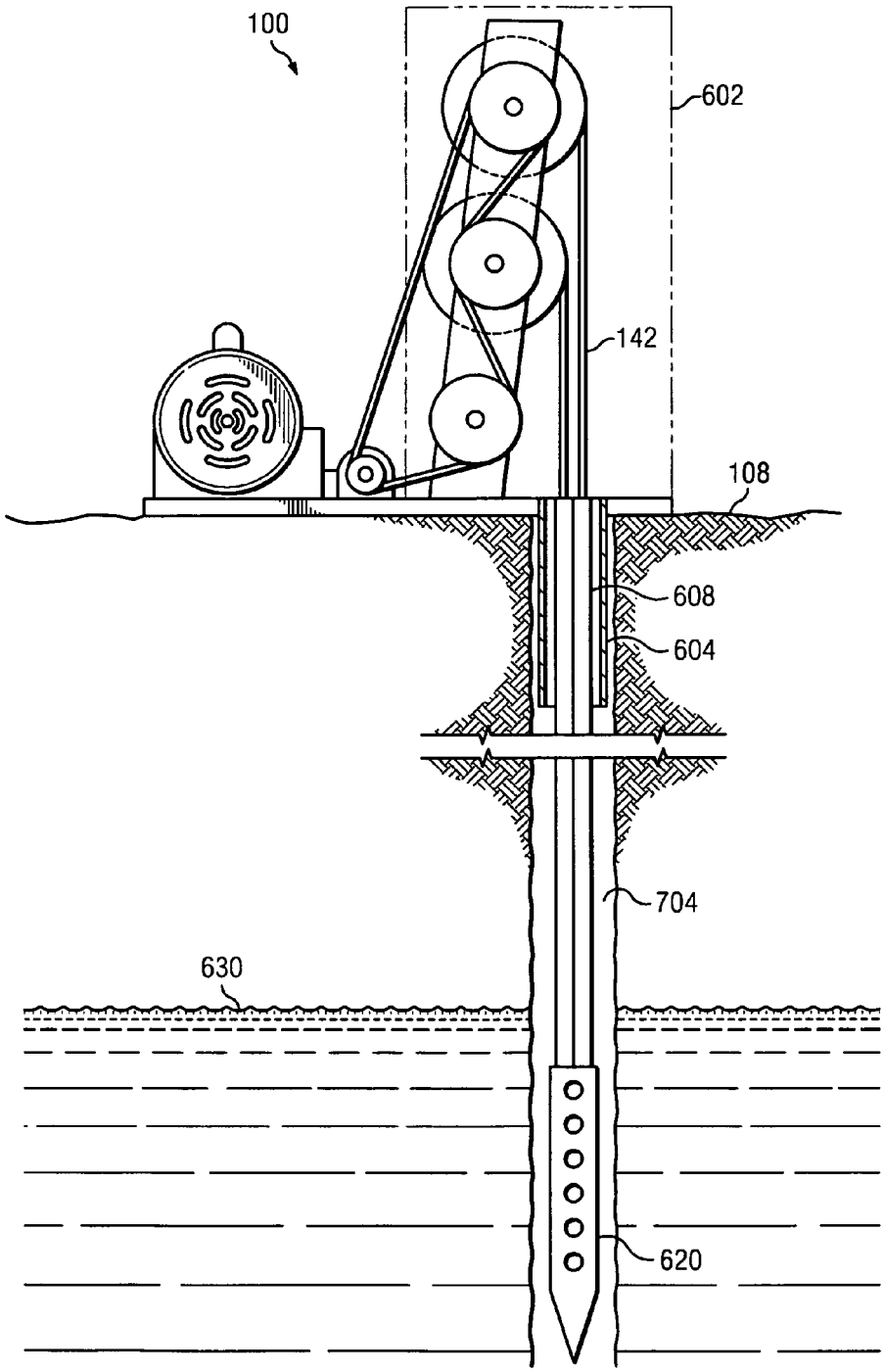
FIG. 7 is a cross-section view of a well bore in operation with the drive head of a preferred embodiment.

Referring to FIGS. 6 and 7, once conveyor 142 passes through exit hole 612 it travels through down chamber 616 of flexible tubing 608. Flexible tubing 608 has two separate passageways that extend throughout the length of flexible tubing 608, down chamber 616 and up chamber 614. Drop housing 620 is affixed to the end of flexible tubing 608 that is furthest from drive head 100. Drop housing 620 is lowered to a sufficient depth in well bore 704 in order to come into contact with fluid 630. Conveyor 142 enters drop housing 620 and travels around distal sheave 624. Distal sheave 624 is secured to a cone shaped section of drop housing 620 shown as nose 622. Drop housing 620 further includes a plurality of inlets 626. Inlets 626 are openings in drop housing 620 which allow fluid 630 to enter into the interior of drop housing 620 and become adjacent to conveyor 142. After looping around distal sheave 624, the conveyor returns through up chamber 614 and begins the path again starting in groove 202 of sheave 110.

In operation, drive head assembly 100 is mounted to standpipe 604 extending from well bore 704. Up portion 302 of conveyor 142 is looped between sheave 110 and sheave 112 in a "figure-8" conveyor path. Down portion 304 is looped around distal sheave 624 secured to drop housing 620. Drop housing 620 is lowered into well bore 704 until it reaches the fluid to be pumped. A power delivery system turns drive shaft 122 which in turn rotates drive wheel 120. Belt 114 is strung around drive wheel 120 and follower wheels 124, 126, and 128. Belt 114 causes follower wheels 124 and 128 to rotate in the same direction as drive wheel 120 and follower wheel 126 to rotate in the opposite direction of drive wheel 120. Belt 114 synchronizes follower wheels 126 and 128 to rotate at the same speed. Follower wheel 128 causes sheave 110 to rotate and follower wheel 126 causes sheave 112 to rotate. As a result, belt 114 synchronizes sheaves 110 and 112 to rotate at the same speed. In the preferred embodiment, follower wheels rotate in the range of approximately 250 RPM to 600 RPM resulting in a conveyor speed ranging between approximately 700 feet per minute (fpm) and 1,700 fpm. However, other speeds are envisioned based on the diameter of the follower wheels, the diameter of the sheave and the overall weight of the conveyor.

In alternate embodiments, follower wheels 124, 126 and 128 may be smooth and driven by a smooth belt. Alternately, they may consist of meshed gears. Finally, they may be sprockets utilizing a chain drive from the drive wheel 120.

Sheaves 110 and 112 pull conveyor 142 up through up chamber 614 of flexible tubing 608, up through entrance hole 610, and around each other. Sheave 112 guides conveyor 142 down through exit hole 612 and through down chamber 616. Down portion 304 of conveyor 142 moves as a result of the force applied by sheaves 110 and 112 to up portion 302. As conveyor 142 travels through the length of well bore 704, conveyor 142 uses the principals of Couette flow theory to entrain a quantity of fluid 630. In fluid dynamics, Couette flow refers to the laminar flow of a viscous liquid in the space between two surfaces, one of which is moving relative to the other. The flow is driven by virtue of viscous drag force acting on the fluid and the applied pressure gradient between the surfaces. Here, the two surfaces are conveyor 142 moving relative to flexible tubing 608. Fluid 630 travels with conveyor 142 up flexible tubing 608 and acts to support, displace, or offset the conveyor from the sides of the tubing. For a more detailed description of a fluid entraining conveyor and flexible tubing advantageously used with the invention, reference is made to U.S. Pat. No. RE 35,266 to Crafton, et al., this is fully incorporated by reference herein.

Fluid 630 enters cover 602 through entrance hole 610 and pools in collection area 618. Fluid 630 is pumped or otherwise transported from collection area 618 through drain hole 606 to a storage receptacle until processed or transported further.

Figure 8:
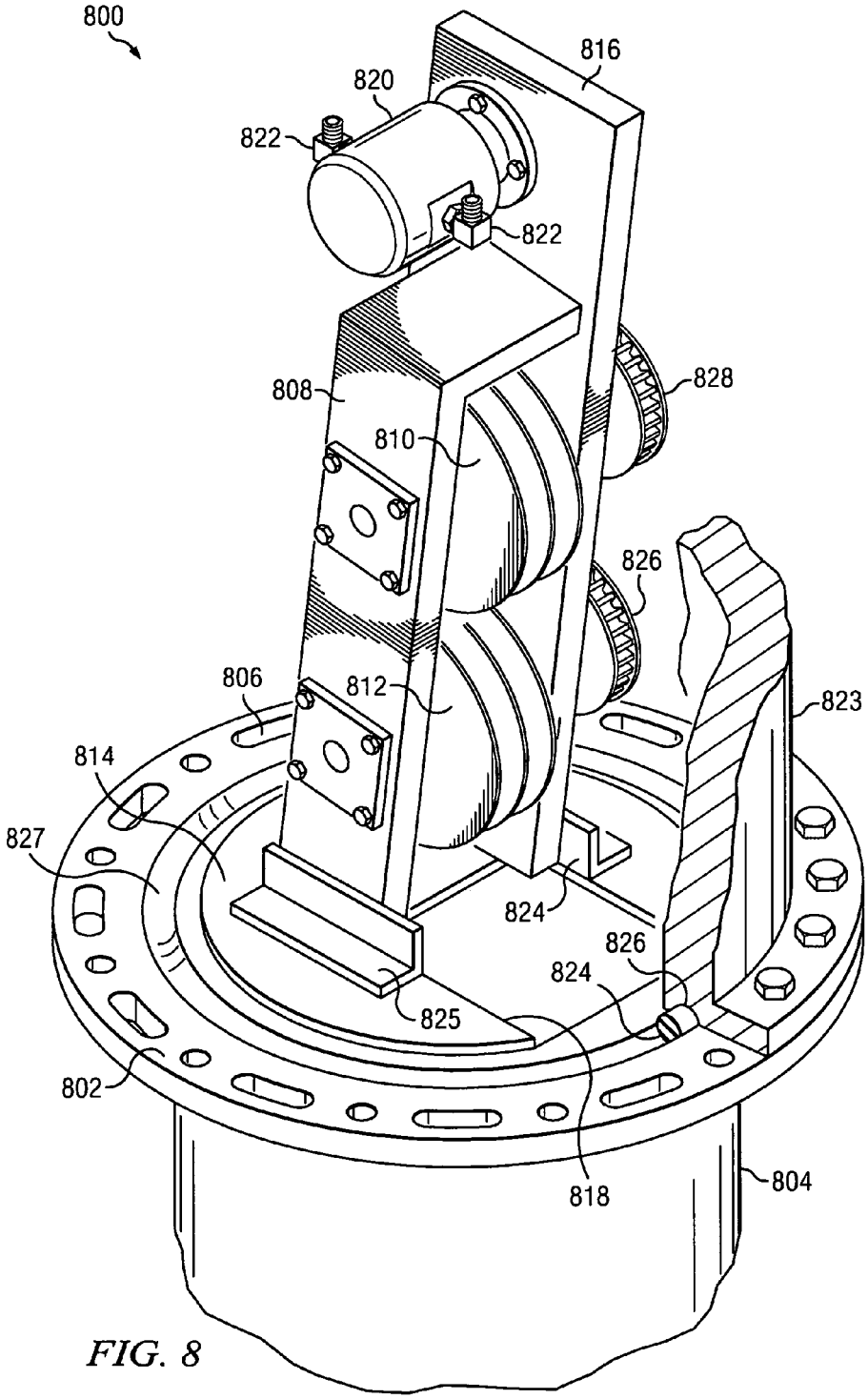
FIG. 8 is an isometric view of an alternate embodiment.

FIG. 8 shows an alternate embodiment of the present invention. Drive head 800, including hydraulic motor 820 and follower wheels 826 and 828 are all encased in sealed cover 823. Cover 823 (shown in cutaway) is generally cylindrical in shape and encloses the working components of drive head 800. Cover 823 is mounted to lip 802 via a plurality of bolts through attachment holes 806. Seal 824 resides in annular grooves 826 and 827. Seal 824, in cooperation with annular grooves 826 and 827, seals the working components of drive head 800 with respect to the outside pressure. Lip 802 is integrally formed with the open end of standpipe 804. Standpipe 804 extends from the upper portion of the well bore. Base 814 is mounted to standpipe 804. Base 814 is a disc shape having rectangular opening 818. Rectangular opening 818 provides access for the conveyor (not shown) down into the well bore. Frame 808 is supported on base 814 by buttresses 824 and 826. In the preferred embodiment, frame 808 extends from base 814 at an angle that ranges from 80° to 85°. However other angles including perpendicular to the base are envisioned.

Frame 808 is generally a rectangular shape and provides mounting points for sheaves 810 and 812 and also follower wheels 826 and 828. Frame 808 includes frame extension 816. Frame extension 816 provides a mounting point for hydraulic motor 820. Hydraulic motor includes valves 822 for input and output of the hydraulic fluid that powers hydraulic motor 820. Sheaves 810 and 812 are mounted on axles which axially rotate in frame 808. Follower wheels 828 and 826 are linearly aligned and mounted on the same axles extending through frame 808.

In the preferred embodiment, follower wheels 828 and 826 have equally spaced cogs for engagement with a double-sided toothed belt. A double-sided toothed belt driven by a drive wheel connected to hydraulic motor 820 rotates follower wheels 826 and 828. Follower wheels 826 and 828 are synchronized to rotate at the same velocity and in opposite directions. By virtue of follower wheels 826 and 828 being mounted on the same rotational axes as sheaves 812 and 810 respectively, sheaves 810 and 812 also rotate at the same speed and in opposite directions.

In alternate embodiments, follower wheels 826 and 828 may be smooth and driven by a smooth belt. Alternately, they may consist of meshed gears. Finally, they may be sprockets utilizing a chain drive from the drive wheel.

Sheaves 810 and 812 are each shown with two coaxial grooves. The total number of coaxial grooves on each sheave can vary depending on the depth of the well bore and the traction required to propel the conveyor. The grooves have a cross-sectional shape of a V with concave sides as previously described. The conveyor is wrapped around the sheaves and down into the well bore via a double chambered flexible tubing in the same manner as described in previous embodiments.

The embodiment in FIG. 8 is used in situations where the fluid to be moved is under pressure. The outer casing includes the cover and standpipe 804, as well as seals and gaskets between them to maintain the pressure. In the preferred embodiment, container vessel can maintain pressure up to several thousand psi. However, greater pressures may be achieved as such casings, seals and fittings are well known in the art.

The present invention is useful for any fluid production system by which fluid is to be transported a long distance using a conveyor. Additionally, the drive head assembly of the present invention incorporating the synchronized sheaves, the "figure-8" conveyor path between the sheaves, and the uniquely shaped grooves of the sheaves can be used in any conveyor configuration wherein high tractive forces are required of the conveyor and prolonged conveyor life is desired.

Figure 10:
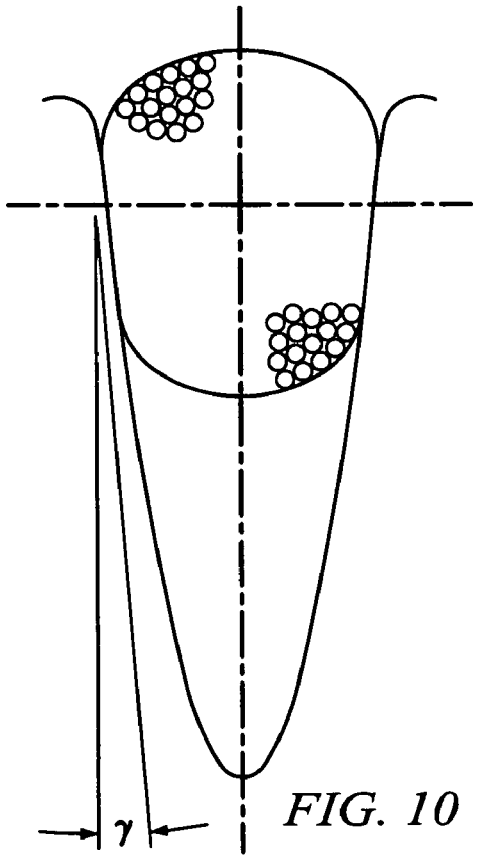
FIG. 10 is a cutaway view of a sheave, showing the deformation of the conveyor inside a sheave.
Figure 9:
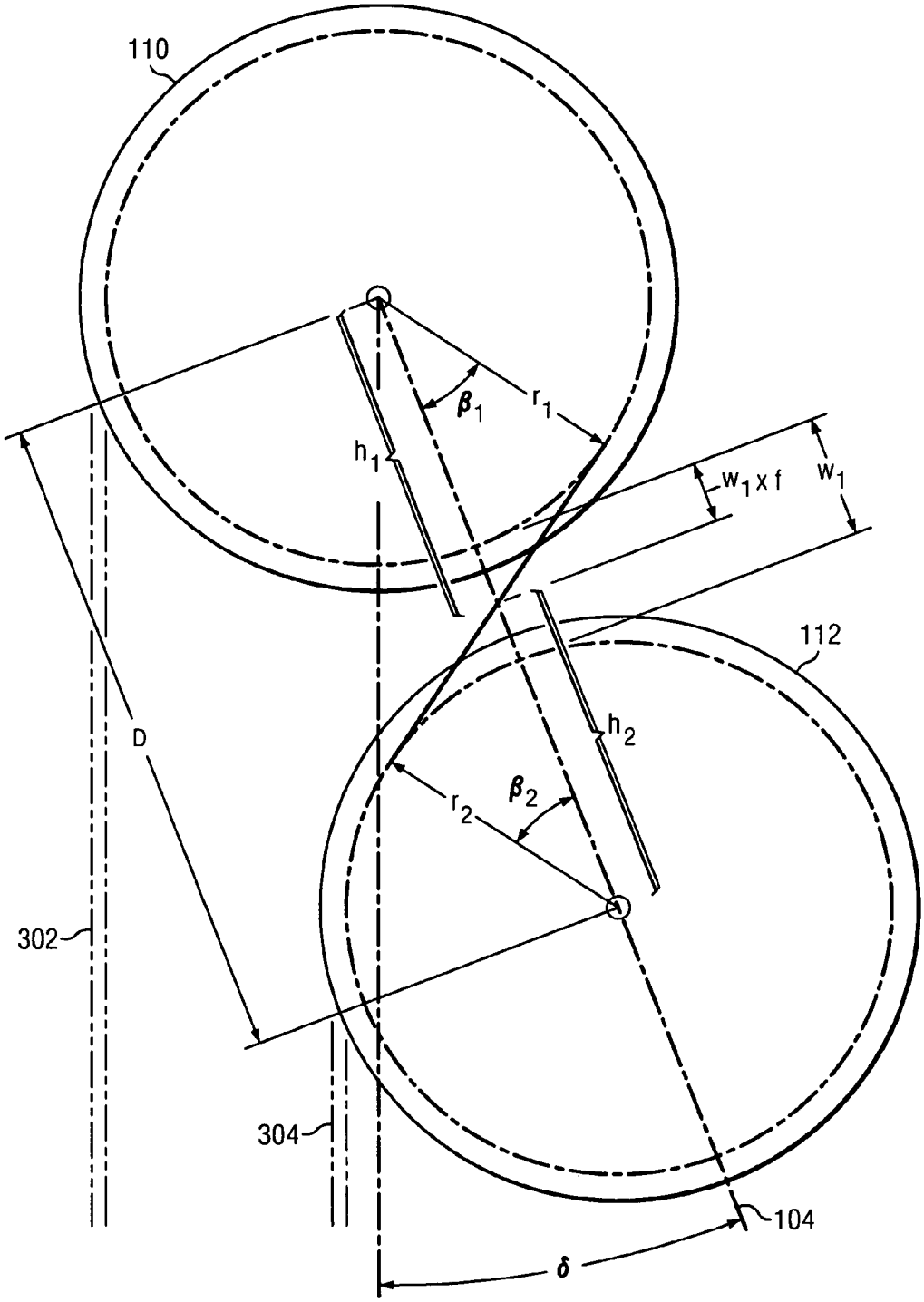
FIG. 9 is a cutaway view of sheaves of FIG. 3, showing the variables necessary to formulate the equations for the radii of each groove in a given sheave.

Referring now to FIGS. 9 and 10 determination of the radii and shape of those grooves will be described assuming an elastic conveyor, driven under tension by friction between the groove walls and the conveyor.

The size of gap, $w_1$, between the sheaves and the grooves controls the departure and entry points for the conveyor in each of the respective sheave grooves. The entry and departure points are the points on the centerline of contact between the groove walls and the conveyor arrives at or leaves from its resting point in the groove. A line is drawn in FIG. 9 between the center point of the first sheave 110 and the departure point of the conveyor and annotated at "$r_1$". A similar line from the center point of the second sheave 112 to the conveyor entry point in its first groove is shown as "$r_2$". A midline 140 is shown between the center points of the two sheaves, which are a distance "D" apart. Notice that the midline 140 is canted from vertical by an angle of δ.

Referring to FIG. 10, the centerline of contact with the conveyor is shown. That centerline is also the location of a point load on the walls and conveyor, which is equivalent to the distributed load over the contact area. FIG. 10 also portrays the cross-section of the sheave grooves and an approximate shape of the loaded conveyor, when in the groove. A V-shaped sheave groove is utilized for ease of calculating angle γ. As previously described, the walls of the groove may be concave to allow for deformation of the conveyor and the pitch between grooves on alternate sheaves. The position of the entry and departure points depends on the conveyor velocity, mechanical properties of the conveyor and geometry of the groove.

The angle between the line denoted as "$r_1$" and the line between the sheave center points is referred to as "$\beta_1$". The angle between "$r_2$" and the midline 140 on the second sheave is identified as "$\beta_2$". Assuming that the conveyor entry and departure points are tangent to the circular centerline of contact, then fundamental principles of analytic geometry require that the angles "$\beta_2$" and "$\beta_1$" are equal. By the same geometric principles that triangles with similar angles must have proportional sides, then:

$$\frac{r_1}{r_2} = \frac{h_1}{h_2} = \frac{r_1 + fw_1}{r_2 + w_1(1-f)} \quad \text{eq. (1}$$

where "$h_1$" represents the distance from the center point of the first sheave 110 and the point where the conveyor crosses the line between the center points and "h2" that relative to the center point of the second sheave. The variable "$w_1$" represents the distance between the grooves of sheave 110 and sheave 112. The distance between the sheave grooves is measured at the centerline of contact with the conveyor, as depicted in FIG. 10.

The value of "f" is related to "$w_1$" such that the product, "$f \times w_1$", is that fraction of the gap from the center of contact on the first sheave 110 to the crossing point of the conveyor. Solving Eqn. 1 for "f" yields:

$$f = \frac{r_1}{r_1 + r_2} \quad \text{eq. (2}$$

so, $$h_1 = r_1\left(1 + \frac{w_1}{r_1 + r_2}\right) \quad \text{eq. (3}$$

and $$h_2 = r_2\left(1 + \frac{w_1}{r_1 + r_2}\right) \quad \text{eq. (4}$$

By those definitions, then:

$$\beta_1 = \cos^{-1}\left(\frac{r_1}{h_1}\right) = \cos^{-1}\left(1 + \frac{r_1 + r_2}{r_1 + r_2 + w_1}\right) \quad \text{eq. (5}$$

So for the first groove on the first sheave 110, the conveyor 302 enters the first sheave 110 at 90 degrees yielding a total conveyor contact angle of:

$$\theta_1 = \left(\frac{3}{2} - \delta - \beta_1\right)\pi \quad \text{eq. (6}$$

Notice that the total contact angle is a function of the radius of the groove on the second sheave 112, because "$\beta_1$" depends on the value of "$r_2$". By similar logic, the total contact angle for the second groove, where the conveyor is more fully in contact with the sheave than the first groove, is:

$$\theta_2 = (2 - \beta_1 - \beta_2)\pi \quad \text{eq. (7}$$

The same relationships applies to all of the other grooves, except for the first and last grooves where the conveyor enters or departs from the sheaves, so $$\theta_i = (2 - \beta_{i-1} - \beta_1)\pi \quad \text{eq. (8}$$

The relationship for the last groove is similar to that of the first groove:

$$\theta_n = \left(\frac{1}{2} - \delta - \beta_{n-1}\right)\pi \quad \text{eq. (9}$$

Where "n" is even and the number of the last groove in the train. The total contact angle still depends on the radii of both the last and preceding sheave grooves.

The combined total contact angle of all the grooves is:

$$\theta_{total} = \left(n - 1 - 2\left(\delta + \sum_{i=1}^{i=n-1} \beta_i\right)\right)\pi \quad \text{eq. (10}$$

So, clearly, the solution for each of the groove total contact angles is iterative, since it depends on the radius of both the groove in question and the following groove. The iterative solution converges to a suitable tolerance in two to five iterations.

If the conveyor were inelastic, the design of the conveyor drive mechanism would simply depend on the coefficient of friction between the conveyor and the sheave groove walls and the combined total contact angle. In fact, the conveyor is quite elastic and for this analysis assumed to exhibit proportional Hookean behavior. That is, the stretch of the bulk conveyor is proportional to the load placed on it. Elastic materials also exhibit a change of shape when loaded. Thus, elastic materials have a functional relationship between the change in length as loading occurs and change in diameter, in this case. The relationship is the Poisson's Ratio. The groove train radii and cross-sections must be corrected for these phenomena.

The change in size of the conveyor depends on these mechanical properties and the change in tension as the conveyor passes through each groove in the train. In order to determine tractive effort exerted by one groove, assuming the parabolic profile shown in FIG. 10, it is necessary to first determine the slope of the side of the grooves where the conveyor contacts the groove wall. The equation describing the parabolic profile is:

$$x^2 = 4p(y-k) \quad \text{eq. (11}$$

Differentiating this equation with respect to "x" gives the slope of the side:

$$\frac{dy}{dx} = \frac{2x}{4p} \quad \text{eq. (12}$$

Thus the angle of the side is:

$$\gamma = \frac{\pi}{2} - \tan^{-1}\left(\frac{dy}{dx}\right). \quad \text{eq. (13}$$

It appears that the angle is dependent on the distance between the sides of the groove (2x). That distance is dependent on the loaded tension, hence diameter, of the conveyor.

If in the unloaded condition, the conveyor has a characteristic length "$L_0$" and diameter "$d_{r0}$", then when fully loaded for entry into the first groove on the first sheave 110, its length will be:

$$L_1 = L_0 + \Delta L = L_0\left(1 + E\frac{T_1}{A_1}\right) \quad \text{eq. (14}$$

where "$T_1$" is the maximum tension load (force) on the conveyor,

"ΔL" represents the change in length

"E" is the elasticity of the material and

"$A_1$" is the cross-sectional area of the loaded conveyor.

The loaded diameter is:

$$d_{r1} = d_{r0}(1-\Delta d_r) = d_{r0}(1-\mu\Delta L) \quad \text{eq. (15}$$

where "μ" is Poisson's Ratio for the bulk conveyor.

The loaded area is then:

$$A_1 - \frac{\pi d_{r1}^2}{4} \quad \text{eq. (16}$$

This computation is also iterative, since the amount of stretch depends on the degree of shrinkage of cross-sectional area. The computation begins by assuming the cross-sectional area of the unloaded conveyor, then correcting the computations as the corrected area in Eqn. 16 is recalculated. The iteration between Eqns. 14-16 is finished when sufficient accuracy is achieved, typically in two to five iterations depending on the elasticity and deformability of the materials.

Based on the diameter determined in Eqn. 15, the aperture of the parabola at the contact centerline is now known. From that dimension, given the desired depth of the groove, typically, but not necessarily, two conveyor diameters, the value of "p" in Eqn. 11 can be determined. Taking the contact centerline to have a relative value of "y" equal to zero, then the value of "p" is:

$$p = \frac{d_{r1}}{40} \quad \text{eq. (17}$$

and since "x" in Eqn. 12 is also equal to "$d_{r1}$", then the slope is not a function of the conveyor properties or diameter. Thus, the angle of the slope is only a function of the chosen depth of the groove.

Since the radius of the first groove would be specified and the width and geometry of the groove are now known, it is possible to determine the amount of tension exerted in the traverse of the groove by the conveyor. The theoretical solution is shown below:

$$T_2 = T_1 \exp\left(\frac{-\sigma\theta_1}{\sin\delta}\right) \quad \text{eq. (18}$$

Recall that "$\theta_1$" depends on the size of the groove in the second sheave 112. The conveyor is now shorter and fatter, because of the reduced tension on it as it leaves the first groove. To minimize wear, it is necessary to require that the conveyor not slip in any of the grooves. Therefore, since it is difficult to change their rotational speed, it is best to select a radius that accommodates the reduced length and increased diameter. The second groove will thus have a slightly smaller radius than the first to compensate for the increased diameter and resulting upward movement of the center of contact of the conveyor. The characteristic length under the new loading conditions is:

$$L_2 = L_0\left(1 + E\frac{T_2}{A_2}\right) \quad \text{eq. (19}$$

where the area and diameter are iterated just as with Eqns. 14-16. So the radius of the second groove (first groove on the second sheave 112) will be:

$$r_2 = r_1\frac{L_2}{L_1} \quad \text{eq. (20}$$

The estimate of "$r_2$" based on the conveyor properties now permits a recalculation of "$\beta_1$" and "$\theta_1$". This external iteration then proceeds until a suitable tolerance for "$r_2$" has been achieved, typically two to five iterations. Notice, also, that the gap, "$w_1$", is also a function of the values of "$r_1$" and "$r_2$". The original value was based on the assumption that the radii were equal, however, now:

$$w_i = D - (r_i + r_{i+1}) \quad \text{eq. (21}$$

for the $i^{th}$ gap, where D is the distance between the sheave center points.

The identical calculation is performed for each subsequent groove/sheave pair, including the last one. The only fundamental difference is the use of the appropriate total contacted angle relationship for each groove (Eqns. 6-10). As previously noted, the computations are iterative, but quickly converge.

A critical test exists for the sizing of the sheaves 110 and 112. The radius of the sheaves must be large enough that the radial force pulling the conveyor into the groove is substantially larger than the centrifugal force attempting to fling the conveyor out of the groove. For the sake of computation, assume a unit length "u" of the conveyor, perhaps one inch or one centimeter. The angle subtended by the length "u" is:

$$\eta_i = \frac{u}{r_i} \quad \text{eq. (22}$$

The radial force pulling the conveyor into the groove over that angle "η" is:

$$T_{ri} = T_i \sin \eta_i \quad \text{eq. (23}$$

The centrifugal force is:

$$T_c = \frac{Wv^2}{gr_i} \quad \text{eq. (24}$$

where

W is the conveyor weight per unit length "u"

g is the gravitational constant, 32.2 ft/sec2 v is the velocity of the conveyor and $r_i$ is the radius of the $i^{th}$ groove As a design criterion of sheave systems, a factor of safety of 10 between the radial force and the centrifugal force is common, yielding:

$$T_{ri} \geqq 10T_C \quad \text{eq. (25}$$

thus defining either a maximum conveyor velocity or a minimum groove and sheave diameter. The maximum velocity imposes a maximum flowrate for a given conveyor/tubing size combination.

While the preferred embodiments shown use a vertical orientation, it is understood and contemplated that the invention may be utilized in a horizontal orientation without departing from the spirit of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A drive head assembly for a fluid conveyor system for extracting fluids from a well bore comprising:

a frame is adjacent a standpipe extending from the well bore;

a power delivery means removably connected to the frame, for rotation of a drive wheel;

a set of synchronized follower wheels driven by the drive wheel;

a set of shafts, comprising a first shaft and a second shaft, rotationally mounted to the frame;

the set of follower wheels, further comprising a first follower wheel mounted on the first shaft and a second follower wheel mounted on the second shaft, wherein the first follower wheel rotates in a first direction and the second follower wheel rotates in a second direction;

a first sheave, having a first perimeter and a first set of coaxial grooves around the first perimeter, mounted on the first shaft;

a second sheave, having a second perimeter and a second set of coaxial grooves around the second perimeter, mounted on the second shaft;

a third sheave, rotationally mounted in the well bore, having a third perimeter and a third set of coaxial grooves around the third perimeter;

a conveyor, wound in a figure-8 path between the first sheave and the second sheave, contacting the first sheave in the first set of grooves and contacts the second sheave in the second set of grooves and the third sheave in the third set of grooves.

2. The drive head assembly of claim 1 wherein a cover is sealed to the standpipe and encases the frame, the set of shafts, the first sheave, and the second sheave.

3. The drive head assembly of claim 2 wherein the cover is pressurized.

4. The drive head assembly of claim 1 wherein a cover is sealed to the standpipe and encases the frame, the power delivery means, the drive wheel, the set of synchronized follower wheels, the set of shafts, the first sheave, and the second sheave.

5. The drive head assembly of claim 4 wherein the power delivery means is one of the set of a hydraulic, an Alternating Current, or a Direct Current motor.

6. The drive head assembly of claim 1 wherein the conveyor contacts the first sheave through at least 270 degrees of the first perimeter and the conveyor contacts the second sheave through at least 270 degrees of the second perimeter.

7. The drive head assembly of claim 1 wherein the set of follower wheels is driven by a double-sided drive belt engaging the drive wheel.

8. The drive head assembly of claim 1 wherein the first set of grooves and the second set of grooves have a groove profile, the groove profile having a cross-section;

wherein the cross-section has a first side and a second side, and wherein the slope of the first side is less than the slope of the second side.

9. The drive head assembly of claim 8 wherein slope of the cross-section of the groove profile is defined by the function:

$$\gamma = \frac{\pi}{2} - \tan^{-1}\left(\frac{dy}{dx}\right).$$

10. A drive head assembly for a fluid conveyor comprising:

a frame mounted to a base, wherein the frame extends from the base at an angle that ranges from 80 to 85 degrees;

a set of linearly aligned follower wheels affixed to a set of shafts, wherein the set of shafts are rotationally mounted in the frame;

the set of follower wheels synchronized to rotate the set of shafts at a first rotational speed;

a set of circular sheaves affixed to the set of shafts and having a first set of circumferential grooves and a second set of circumferential grooves, wherein the first set of grooves and the second set of grooves have a cross-sectional shape controlled by a function;

the cross-sectional shape has a first side and a second side, where the function generates a slope for the first side that is less than the slope generated for the second side; and, the endless conveyor looped around the set of sheaves in a figure-8 path, wherein the conveyor engages the set of sheaves in the first set of grooves and engages the set of sheaves in the second set of grooves.

11. The drive head assembly of claim 10 wherein the set of circular sheaves comprises a first sheave and a second sheave.

12. The drive head assembly of claim 11 wherein the first sheave rotates in a first direction and the second sheave rotates in a second direction.

13. The drive head assembly of claim 10 wherein the conveyor engages the circumference of the first set of grooves through at least 270 degrees and the conveyor engages the circumference of the second set of grooves through at least 270 degrees.

14. The drive head assembly of claim 10 wherein the set of follower wheels engages a belt drive connected to a motor.

15. The drive head assembly of claim 14 wherein a cover encloses the frame, the motor, the belt drive, the set of linearly aligned follower wheels, the set of shafts, and the set of sheaves and wherein the cover is sealed to a standpipe extending from a well bore.

16. The drive head assembly of claim 10 wherein a cover encloses the frame, the set of shafts, and the set of circular sheaves and wherein the cover is sealed to a standpipe extending from a well bore.

17. The drive head assembly of 16 wherein the cover is pressurized.

18. The drive head assembly of claim 10 wherein the conveyor is further looped around a distal sheave secured in a well bore.

19. A method for extracting fluids from a well bore to a receptacle on the surface comprising:

providing a frame mounted to a base, wherein the frame extends from the base at an angle that ranges from 80 to 85 degrees;

providing a power delivery means, removably connected to the frame, for rotation of a drive wheel;

providing a double-sided drive belt engaging the drive wheel, a first synchronized follower wheel, and a second synchronized follower wheel;

providing a first shaft rotationally mounted in the frame and connected to the first synchronized follower wheel and a second shaft rotationally mounted in the frame and connected to the second synchronized follower wheel;

providing a first sheave, having a first perimeter and a first set of coaxial grooves around the first perimeter, connected to the first shaft and a second sheave, having a second perimeter and a second set of coaxial grooves around the second perimeter, connected to the second shaft, wherein the first set of coaxial grooves and the second set of coaxial grooves have a groove profile controlled by a function, the function generating a slope for a first side of the groove and a slope for a second side of the groove, where the slope of the first side is less than the slope of the second side;

providing a conduit, having a first chamber and a second chamber, connected to housing, where the housing contains a set of inlets and a third sheave;

providing an endless conveyor looped around the first set of coaxial grooves and the second set of coaxial grooves in a figure-8 path, where the conveyor contacts the first perimeter for at least 270 degrees and contacts the second perimeter for at least 270 degrees, and where the conveyor is further looped around the third sheave;

providing a cover, connected to the receptacle, where the cover encases the frame, the first sheave, and the second sheave;

sealing the cover to a standpipe extending from the well bore;

looping the conveyor through the first chamber and around the third sheave;

looping the conveyor through the second chamber and back to the first set of coaxial grooves;

lowering the housing into the well bore and contacting the fluid;

allowing the fluid to seep through the plurality of inlets and become adjacent to the conveyor;

rotating the drive wheel by operating the power delivery means;

causing the rotation of the first synchronized follower wheel and the second synchronized follower wheel in opposite directions;

causing the rotation of the first sheave and the second sheave in opposite directions;

propelling the conveyor around the first sheave and the second sheave;

propelling the conveyor down the first chamber, around the third sheave, and up the second chamber;

entraining the fluid;

pooling the fluid in the cover; and, pumping the pooled fluid to the receptacle for storage.

20. A drive head assembly for a fluid conveyor system for extracting fluids from a well bore comprising:

a frame is adjacent a standpipe extending from the well bore;

a power delivery means removably connected to the frame, for rotation of a drive wheel;

a set of synchronized follower wheels driven by the drive wheel;

a set of shafts, comprising a first shaft and a second shaft, rotationally mounted to the frame;

the set of follower wheels, further comprising a first follower wheel mounted on the first shaft and a second follower wheel mounted on the second shaft, wherein the first follower wheel rotates in a first direction and the second follower wheel rotates in a second direction;

a first sheave, having a first perimeter and a first set of coaxial grooves around the first perimeter, mounted on the first shaft and a second sheave, having a second perimeter and a second set of coaxial grooves around the second perimeter, mounted on the second shaft; and, a conveyor, wound in a figure-8 path between the first sheave and the second sheave, contacts the first sheave in the first set of grooves and contacts the second sheave in the second set of grooves, wherein the distance from the conveyor's center to the center of the sheave is reduced for each consecutive groove of the first or second sheave is reduced to compensate for the increased diameter of the conveyor and the conveyor is further wound around a third sheave located in the well bore.

21. The drive head assembly of claim 20 wherein the first groove has a first groove profile and the second groove has a second groove profile, and the groove profile of each consecutive groove on a given sheave increases in width, based on the increase in diameter of the conveyor as tension is reduced.

22. The drive head assembly of claim 20 wherein the distance from the conveyor's center to the center of the sheave of a given groove is determined such that, the radial force applied to the conveyor by a given sheave, governed by the equation: $T_{ri}=T_i \sin \eta_i$ is larger than the centrifugal force acting on the conveyor, governed by the equation:

$$T_c = \frac{Wv^2}{gr_i}.$$

23. The drive head assembly of claim 22 wherein the ratio between the radial force applied to the conveyor and the centrifugal force acting on the conveyor is a predetermined factor of safety.

24. The drive head assembly of claim 23 wherein the predetermined factor of safety is 10 or greater.

25. A drive head assembly for a fluid conveyor system for extracting fluids from a well bore comprising:

a frame is adjacent a standpipe extending from the well bore;

a power delivery means removably connected to the frame, for rotation of a drive wheel;

a set of synchronized follower wheels driven by the drive wheel;

a set of shafts, comprising a first shaft and a second shaft, rotationally mounted to the frame;

the set of follower wheels, further comprising a first follower wheel mounted on the first shaft and a second follower wheel mounted on the second shaft, wherein the first follower wheel rotates in a first direction and the second follower wheel rotates in a second direction;

a first sheave, having a first perimeter and a first set of coaxial grooves around the first perimeter, mounted on the first shaft and a second sheave, having a second perimeter and a second set of coaxial grooves around the second perimeter, mounted on the second shaft; and, a conveyor, wound in a figure-8 path between the first sheave and the second sheave, contacts the first sheave in the first set of grooves and contacts the second sheave in the second set of grooves, and the conveyor is further wound around a third sheave located in the well bore, wherein the distance from the conveyor's center to the center of the sheave of each consecutive groove of the first or second sheave is reduced to compensate for the increased diameter of the conveyor, such that:

$$r_{n+1} = r_n \frac{L_{n+1}}{L_n}.$$

* * * * *